US009310741B2

(12) United States Patent
Matsui et al.

(10) Patent No.: US 9,310,741 B2
(45) Date of Patent: Apr. 12, 2016

(54) IMAGE FORMING APPARATUS AND COLORIMETRIC APPARATUS

(71) Applicant: CANON KABUSHIKI KAISHA, Tokyo (JP)

(72) Inventors: Norio Matsui, Mishima (JP); Tomoharu Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/146,946

(22) Filed: Jan. 3, 2014

(65) Prior Publication Data

US 2014/0199085 A1 Jul. 17, 2014

(30) Foreign Application Priority Data

Jan. 16, 2013 (JP) ..... 2013-005707

(51) Int. Cl.

| | |
|---|---|
| ***G03G 15/00*** | (2006.01) |
| ***G03G 15/043*** | (2006.01) |
| ***G03G 15/23*** | (2006.01) |
| ***G03G 15/01*** | (2006.01) |

(52) U.S. Cl.

CPC ..... *G03G 15/5062* (2013.01); *G03G 15/0189* (2013.01)

(58) Field of Classification Search

CPC ..... G03G 15/55; G03G 15/5062
USPC ..... 399/15
See application file for complete search history.

(56) References Cited

U.S. PATENT DOCUMENTS

| | | | | |
|---|---|---|---|---|
| 2003/0138261 | A1 * | 7/2003 | Tezuka et al. | 399/49 |
| 2003/0227654 | A1 * | 12/2003 | Shiraishi | 358/474 |
| 2005/0207762 | A1 * | 9/2005 | Funabiki | 399/15 |
| 2006/0008285 | A1 * | 1/2006 | Yoshizuka et al. | 399/49 |
| 2010/0028029 | A1 * | 2/2010 | Yokoyama | 399/39 |
| 2011/0217052 | A1 * | 9/2011 | Usui et al. | 399/15 |
| 2012/0057208 | A1 * | 3/2012 | Ito | 358/448 |
| 2012/0070200 | A1 * | 3/2012 | Hyoki | 399/297 |
| 2013/0011153 | A1 * | 1/2013 | Toriyabe | 399/49 |
| 2014/0199085 | A1 * | 7/2014 | Matsui et al. | 399/15 |

FOREIGN PATENT DOCUMENTS

| | | | |
|---|---|---|---|
| JP | 2005-258026 | A | 9/2005 |
| JP | 2005-292431 | A | 10/2005 |
| JP | 2006-11205 | A | 1/2006 |
| JP | 2009-111808 | A | 5/2009 |

* cited by examiner

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

When a colorimeter is colorimetrically measuring a test pattern, a control unit controls a motor such that the colorimeter and a facing member are closer to each other. A recording material on which the test pattern has been formed is brought into contact with the colorimeter. Even when the colorimeter is not colorimetrically measuring the test pattern, the control unit controls the motor such that the colorimeter and the facing member are closer to each other. The recording material on which the test pattern has been formed is brought into contact with the colorimeter.

19 Claims, 10 Drawing Sheets

| | SINGLE-SIDED PRINTING | DOUBLE-SIDED PRINTING | COLORIMETRIC MEASUREMENT | OTHERS |
|---|---|---|---|---|
| COM. Ex. | SEPARATION | SEPARATION | CONTACT | SEPARATION |
| Ex. | CONTACT | SEPARATION/ CONTACT | CONTACT | CONTACT |

IMAGE FORMING APPARATUS AND COLORIMETRIC APPARATUS

BACKGROUND OF THE INVENTION

1. Field of the Invention

The present invention relates to an image forming apparatus having a colorimetric function and a colorimetric apparatus.

2. Description of the Related Art

Multi-color image forming apparatuses for forming multi-color images are required to form images with stable tints on recording materials for a long period of time. In order to satisfy this request, it is conceivable to form a plurality of patterns having different colors on a recording material, measure the colors using a colorimeter, and provide feedback to image forming conditions (Japanese Patent Laid-Open Nos. 2005-292431 and 2006-11205).

Japanese Patent Laid-Open No. 2005-292431 proposes an apparatus in which two conveyance guides sandwich a recording material therebetween in order to stabilize the attitude of the recording material during colorimetric measurement. Accordingly, a driving source for driving the conveyance guides becomes necessary. Furthermore, Japanese Patent Laid-Open No. 2006-11205 describes an apparatus in which a color sensor is projected into a conveyance path and is brought into contact with a recording material when detecting a test pattern, and the color sensor is withdrawn from the conveyance path when not detecting a test pattern. That is to say, the color sensor and a recording material are usually separated from each other, and are closer to each other only during colorimetric measurement. Compared with Japanese Patent Laid-Open No. 2005-292431, Japanese Patent Laid-Open No. 2006-11205 is advantageous in that one of the conveyance guides can be omitted because the function thereof is performed by the color sensor.

However, according to the invention of Japanese Patent Laid-Open No. 2006-11205, the color sensor and a biasing plate facing the color sensor are separated from each other when not detecting a test pattern, and, thus, the color sensor may be contaminated with floating residual paper dust, dust from the outside, and the like. Contamination of the color sensor lowers the precision of the colorimetric measurement (reduces the light amount and increases the stray light amount), thereby making it difficult to suppress a change in the tint. Note that, during colorimetric measurement, a recording material passes through a point between the color sensor and the biasing plate while keeping contact therewith, and, thus, a colorimetric window part of the color sensor can be cleaned. However, if cleaning intervals are prolonged, the contamination level progresses, and passing of only one sheet of recording material on which a test pattern has been formed may not be sufficient to clean the measurement window.

SUMMARY OF THE INVENTION

The present invention provides a multi-color image forming apparatus in which contamination of a colorimeter can be reduced compared with conventional examples.

The present invention provides an image forming apparatus comprising the following elements. A fixing unit fixes a toner image to a recording material. A colorimetric unit is provided on a conveyance path downstream of the fixing unit in a recording material conveyance direction, and colorimetrically measures a test pattern formed on the recording material. A facing member faces the colorimetric unit. The conveyance path interposed between the facing member and the colorimetric unit. A drive unit drives the colorimetric unit or the facing member such that the colorimetric unit and the facing member are closer to each other or separated from each other. A control unit controls the drive unit. In a case where a contact condition for contact of the colorimetric unit with the recording material is satisfied, the control unit controls the drive unit such that the colorimetric unit and the facing member are closer to each other, so that contact of the colorimetric unit with the recording material is allowed, regardless of whether or not the test pattern has been formed on the recording material.

Further features of the present invention will become apparent from the following description of exemplary embodiments with reference to the attached drawings.

DESCRIPTION OF THE EMBODIMENTS

According to the present invention, at least one of the method for suppressing attachment of contamination to the colorimetric window part of the colorimeter and the method for increasing opportunities to clean the colorimeter with recording materials is used as the method for reducing contamination of the colorimeter compared with conventional examples. In conventional examples, a colorimeter and a biasing plate (facing member) are usually separated from each other, and the colorimeter and the biasing plate are proximal to or in contact with each other only when colorimetric measurement is being performed. That is to say, the duration during which the colorimeter and the biasing plate are separated from each other is very long, and, thus, contamination is attached to the measurement window part of the colorimeter during that separation duration. Accordingly, in some embodiments, the colorimeter and the biasing plate are in principle proximal to or in contact with each other, and they are separated from each other as necessary. Accordingly, the duration during which the colorimeter and the biasing plate are separated from each other becomes shorter, and attachment of contamination to the colorimetric window part is suppressed compared with conventional examples. Furthermore, in some embodiments, even when colorimetric measurement is not being performed, a recording material is caused to clean the colorimetric window part when a predetermined condition is satisfied. Accordingly, adhesion of contamination to the colorimetric window part is suppressed compared with conventional examples.

Outline of the Multi-Color Image Forming Apparatus

Figure 1:
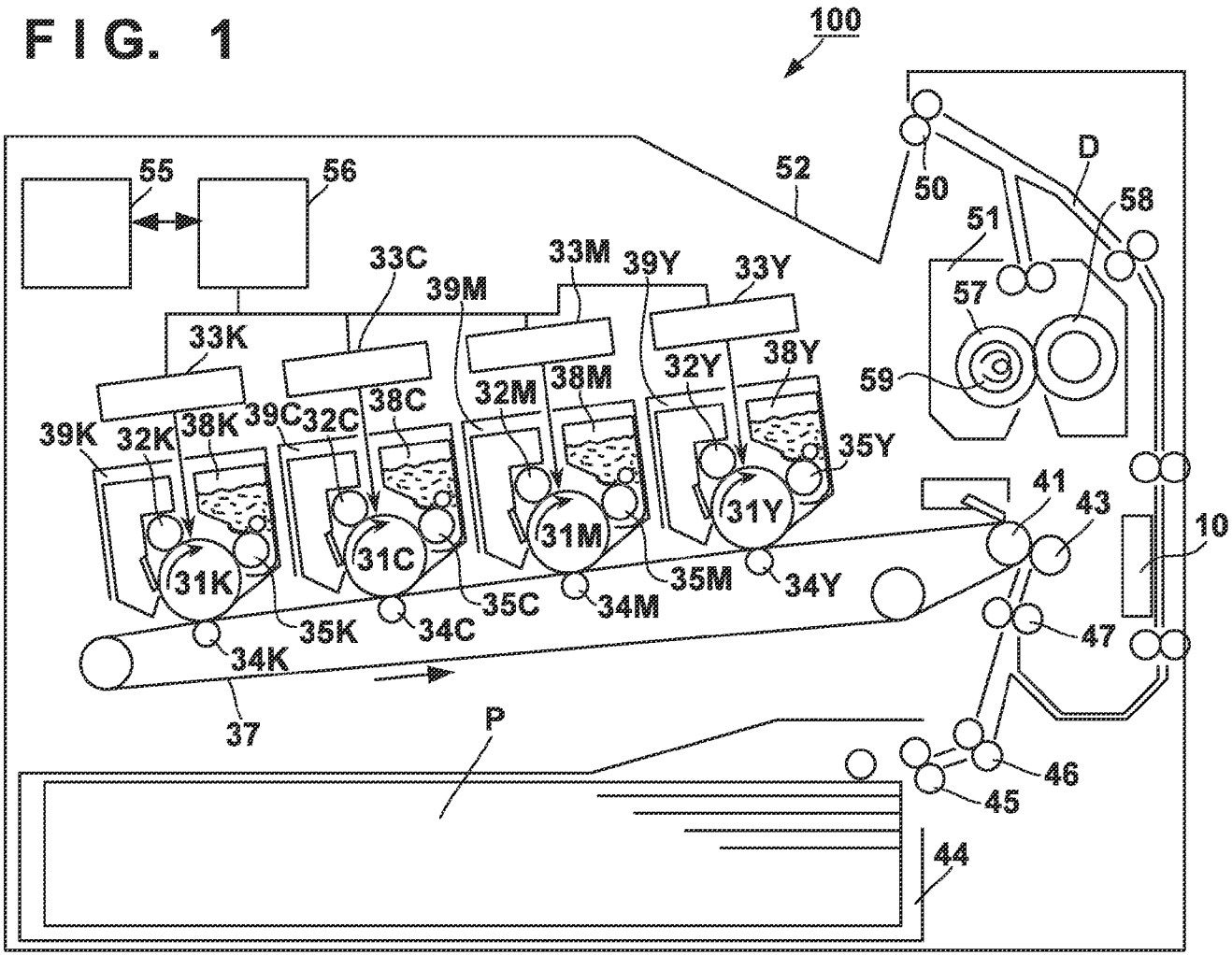
FIG. 1 is a view showing an example of an image forming apparatus.

Hereinafter, an example of a multi-color image forming apparatus will be described with reference to FIG. 1. An image forming apparatus 100 is a tandem image forming apparatus using an intermediate transfer belt 37. The image forming unit has four stations for forming toner images with toners of different colors. Note that Y, M, C, and K affixed to the last of reference numerals indicate yellow, magenta, cyan, and black, which are colors of toners. Furthermore, in descriptions of matters common to these four colors, reference numerals are indicated without YMCK.

A photosensitive drum 31 is an image carrier that is formed by coating the outer circumference of an aluminum cylinder with an organic photoconductive layer, and that rotates when receiving a driving force transmitted from a drive motor (not shown). The drive motor rotates the photosensitive drum 31 clockwise according to an image forming operation. Upon receipt of an image signal, a main body control unit 55 gives an image formation control unit 56 an instruction to form an image. The image formation control unit 56 rotates paper feed rollers 45 and 46, so that a recording material P is sent from a paper feed cassette 44 onto a conveyance path. The image formation control unit 56 controls a conveyance roller pair 47 in order to synchronize the position of the recording material P with the toner image conveyance position. The conveyance roller pair 47 also may be referred to as a registration roller pair.

The image formation control unit 56 applies a charge bias to a charging roller 32, so that the surface of the photosensitive drum 31 is uniformly charged. In response to the image signal, the image formation control unit 56 controls an exposure scanner unit 33 to output laser light, so that an electrostatic latent image is formed on the surface of the photosensitive drum 31. The image formation control unit 56 applies a development bias to a development unit 38, so that toner is supplied from the development unit 38 and the electrostatic latent image is developed into a toner image. Note that the development bias is applied to a sleeve 35. Furthermore, the photosensitive drum 31, the charging roller 32, and the development unit 38 are integrally formed as a toner cartridge 39 that is detachably attached to the main body of the image forming apparatus 100.

The intermediate transfer belt 37 is an intermediate transfer member or an image carrier that is in contact with the photosensitive drums 31Y, 31M, 31C, and 31K, and that rotates in synchronization with the rotation of the photosensitive drums 31Y, 31M, 31C, and 31K. The developed monochrome toner images are sequentially transferred to the intermediate transfer belt 37 due to the action of a primary transfer bias applied to primary transfer rollers 34. Accordingly, a multi-color toner image is formed on the intermediate transfer belt 37.

The multi-color toner image formed on the intermediate transfer belt 37 is conveyed to a secondary transfer nip part configured by a drive roller 41 and a secondary transfer roller 43. The recording material P held in a waiting state by the conveyance roller pair 47 is conveyed by the conveyance roller pair 47 to the secondary transfer nip part. A secondary transfer bias is applied to the secondary transfer roller 43, so that the multi-color toner image on the intermediate transfer belt 37 is altogether transferred to the recording material P.

A fixing unit 51 fixes the toner image to the recording material. The fixing unit 51 fuses and fixes the transferred multi-color toner image to the recording material P that is being conveyed. A fixing roller 57 has a heater 59, and heats the recording material P. A pressure roller 58 presses the recording material P against the fixing roller 57.

The recording material P carrying the multi-color toner image is conveyed by the fixing roller 57 and the pressure roller 58, and receives heat and pressure therefrom, so that the toner image is fixed to the surface of the recording material P. The recording material P to which the toner image has been fixed is discharged by discharge rollers 50 onto a paper discharge tray 52. Note that, in the case of forming images not only on a first face but also on a second face, the switch-back operation by the discharge rollers 50 sends the recording material via a double-sided conveyance path D again into the conveyance roller pair 47. Subsequently, the above-described series of image forming operations are performed, and, thus, an image is formed on the second face of the recording material P.

A colorimeter 10 is provided on the conveyance path downstream of the fixing unit in the recording material conveyance direction, and functions as a colorimetric unit that colorimetrically measures a test pattern formed on the recording material. The colorimeter 10 includes a color sensor, for example, having a light emitting unit that emits light onto a test pattern formed on the recording material P and a light receiving unit that receives light reflected from the test pattern. The colorimeter 10 is disposed at the center in the longitudinal direction on the double-sided conveyance path D in order to colorimetrically measure the test pattern. Note that the longitudinal direction refers to a direction orthogonal to the conveyance direction of the recording material P.

Test Pattern

Figure 2:
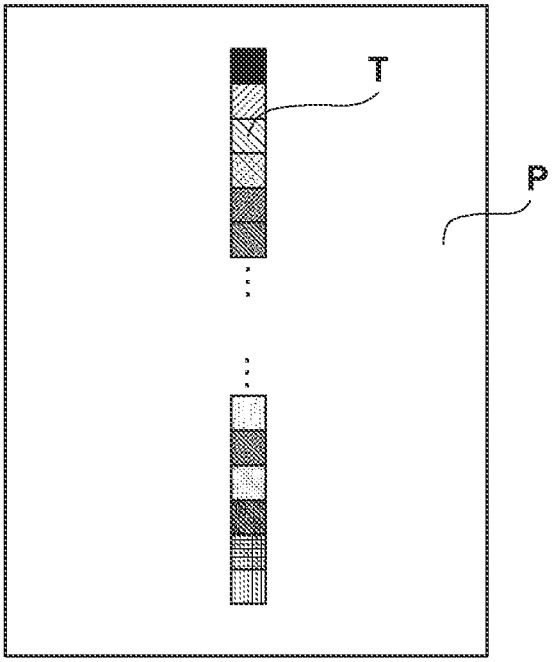
FIG. 2 is a view showing an example of a test pattern.

Hereinafter, an example of a test pattern will be described with reference to FIG. 2. Upon receipt of an instruction to perform colorimetric measurement from the main body control unit 55, the image formation control unit 56 starts to form a test pattern T. The test pattern T is an image used to maintain proper tints of images formed on the recording material P. The test pattern T includes a plurality of patterns having different colors and tones. The colorimeter 10 reads the test pattern T, and the image formation control unit 56 uses the reading result to adjust image forming conditions (charge bias, development bias, transfer bias, density/tone conversion table, etc.). Note that the method for adjusting the image forming conditions using the colorimetric measurement result is known, and, thus, a description thereof has been omitted.

Embodiment 1

In Embodiment 1, the colorimeter 10 and a facing member 16 are in principle proximal to or in contact with each other, and they are separated from each other as necessary. Accordingly, the duration during which the colorimeter 10 and the facing member 16 are separated from each other in Embodiment 1 is shorter than that of a comparative example in which the colorimeter 10 and the facing member 16 are in principle separated from each other, and, thus, attachment of contamination to a colorimetric window part 11 is suppressed. Furthermore, in Embodiment 1, not only when colorimetric measurement is being performed, but also when a predetermined condition is satisfied, the colorimetric window part 11 is projected into the conveyance path and is brought into contact with the recording material P, so that the colorimetric window part 11 is cleaned. Accordingly, adhesion of contamination to the colorimetric window part 11 is suppressed compared with a comparative example in which the colorimetric window part 11 is projected into the conveyance path only during colorimetric measurement.

Figure 3:
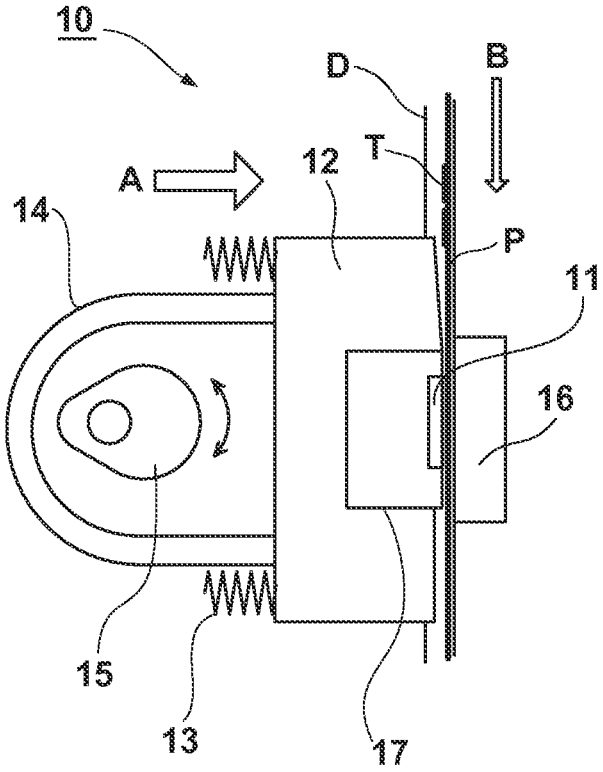
FIG. 3 is a view showing the position of a colorimeter in a colorimetric measurement mode.
Figure 4:
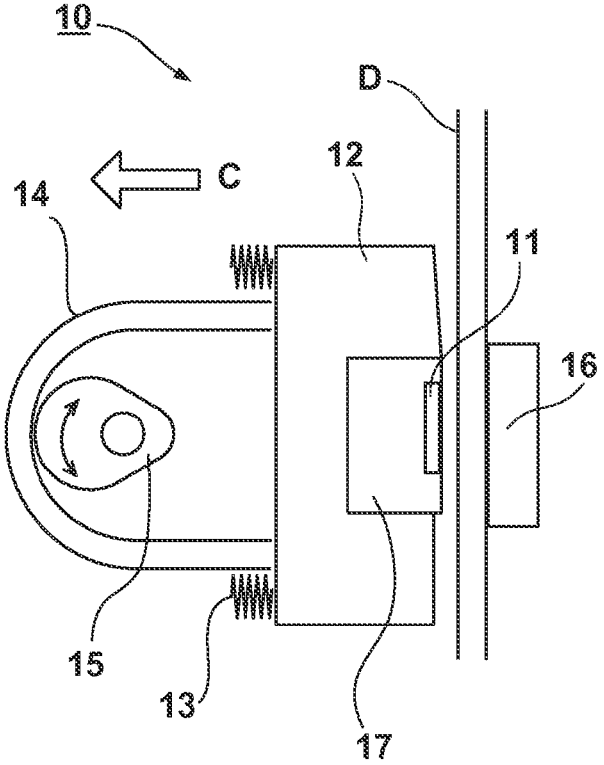
FIG. 4 is a view showing the withdrawn position of the colorimeter.

Hereinafter, a basic operation of the colorimeter 10 will be described with reference to FIGS. 3 and 4. FIG. 3 shows a state (projected state and contact state) in which the colorimeter 10 is projected into the double-sided conveyance path D, and the recording material P is sandwiched between and conveyed by the colorimetric window part 11 of the colorimeter 10 and the facing member 16. FIG. 4 shows a state (withdrawn state and separation state) in which the colorimeter 10 is withdrawn from the double-sided conveyance path D.

A color sensor 17 of the colorimeter 10 is held by a holder 12. The colorimetric window part 11 of the color sensor 17 is provided at the front end in the projecting direction of the holder 12. The color sensor 17 includes a light emitting unit such as an LED and a light receiving unit such as a photoelectric transducer. Biasing springs 13 are attached to the holder 12. The biasing springs 13 bias the holder 12 in the arrow A direction. The arrow B indicates the direction in which the recording material P is conveyed. The double-sided conveyance path D is configured by two conveyance guides. The colorimetric window part 11 is projected into the double-sided conveyance path D, and has been moved closer to the facing member 16 that is provided facing the colorimetric window part. Herein, "closer to" refers to a state in which the colorimetric window part 11 is proximal to the facing member 16 such that the colorimetric window part 11 is in contact with the facing member 16 or the recording material P during passage is in contact with the colorimetric window part 11. The facing member 16 functions as a facing member that is disposed facing the colorimeter 10 with the conveyance path interposed therebetween. Part of the conveyance guide on the colorimeter 10 side is provided with a hole through which the colorimeter 10 is projected and withdrawn. The recording material P that is being sandwiched between the colorimetric window part 11 of the colorimeter 10 and the facing member 16 receives a conveyance force from conveyance rollers (not shown), and moves in the arrow B direction on the double-sided conveyance path D.

The color sensor 17 of the colorimeter 10 colorimetrically measures the test pattern T formed on the recording material P when the recording material P is passing by the colorimetric window part 11. When the colorimetric measurement ends, the image formation control unit 56 rotates a cam unit 15 and lifts a lift arm unit 14 of the holder 12. As shown in FIG. 4, the colorimeter 10 is withdrawn from the double-sided conveyance path D overcoming the biasing force of the biasing springs 13. That is to say, the colorimeter 10 moves in the arrow C direction. Accordingly, a gap is formed between the colorimetric window part 11 and the facing member 16, and the colorimetric window part 11 is exposed.

As described above, in a comparative example, in a usual time during which no colorimetric measurement is performed, the colorimetric window part 11 is exposed to the gap in the conveyance path, and, thus, flying paper dust and the like generated by paper feeding or the like are easily attached to the colorimetric window part 11. That is to say, in the comparative example, the duration in the separation state shown in FIG. 4 is significantly longer than the duration in the contact state shown in FIG. 3, and, thus, contamination easily occurs.

Figure 6:
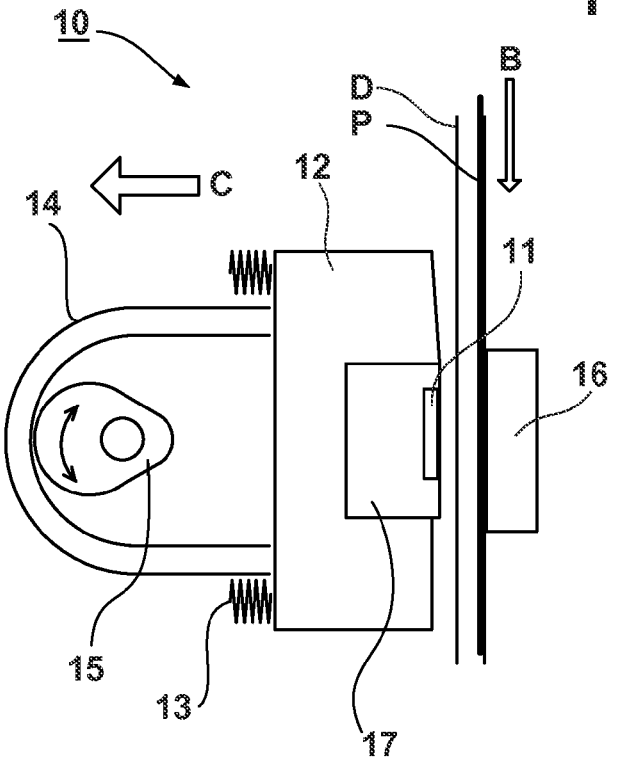
FIG. 6 is a view showing the withdrawn position of the colorimeter in a double-sided printing mode.
Figure 7:
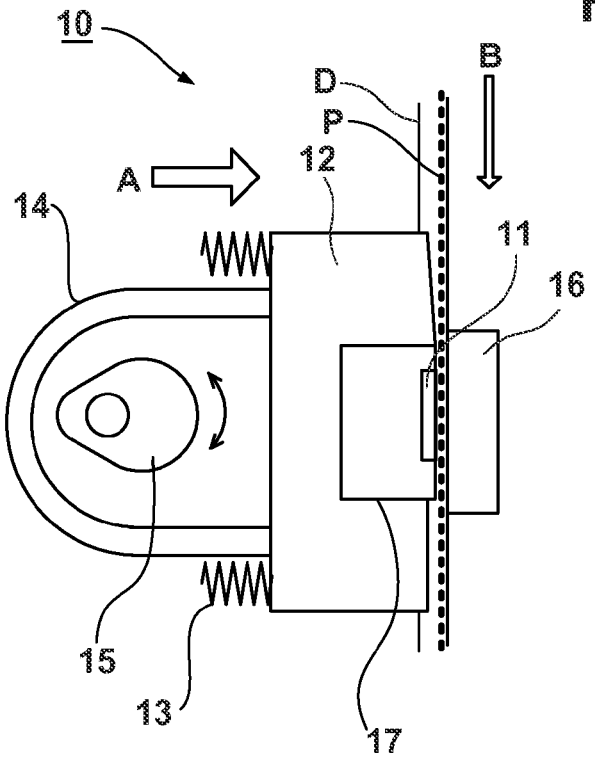
FIG. 7 is a view showing the colorimeter cleaning position in a double-sided printing mode.

Next, characteristic states of the colorimeter 10 of this embodiment will be described with reference to FIGS. 5, 6, and 7. Image forming is in one of three states. A first state is a single-sided printing state (single-sided printing mode) in which an image is formed only on a first face of the recording material P. A second state is a double-sided printing state (double-sided printing mode) in which an image is formed on both of a first face and a second face of the recording material P. A third state is a colorimetric measurement state (colorimetric measurement mode) in which a colorimetric measurement is performed.

Single-Sided Printing State

Figure 5:
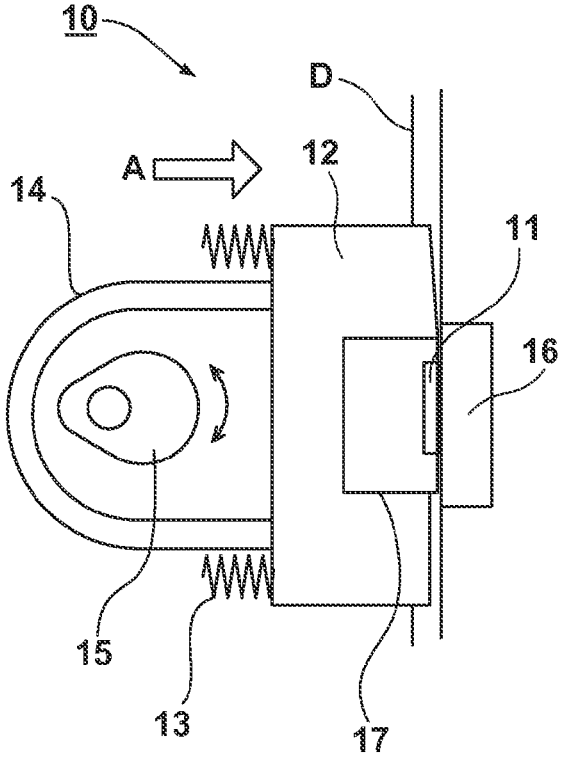
FIG. 5 is a view showing the position of the colorimeter when a colorimetric window part is protected by a facing member.

In a waiting state before the main body control unit 55 gives a single-sided printing instruction, the image formation control unit 56 rotates the cam unit 15, thereby moving the colorimeter 10 to the position in FIG. 5. As shown in FIG. 5, the biasing springs 13 move the holder 12 in the arrow A direction, and, thus, the colorimeter 10 enters the double-sided conveyance path D, and the colorimetric window part 11 is brought into contact with the facing member 16. Since the colorimetric window part 11 is covered by the facing member 16, paper dust and the like are hardly attached to the colorimetric window part 11. Note that the colorimeter 10 does not necessarily have to be in contact with the facing member 16 throughout the duration in the waiting state. For example, even if the contact is made when a predetermined period of time has passed after image formation was ended or when an image forming instruction is received, it is possible to suppress attachment of paper dust and the like to the colorimetric window part 11.

Since the image forming unit forms an image on a single side of the recording material P, the recording material P does not pass through the double-sided conveyance path D. Incidentally, while the recording material P is being conveyed through the inside of the image forming apparatus 100, floating paper dust is generated, and is moved by a convective air flow generated by a fan or the like. Furthermore, floating matter such as dust may enter the image forming apparatus 100 from the outside. In this embodiment, in the single-sided printing state, the colorimetric window part 11 of the colorimeter 10 is protected by the facing member 16, and, thus, contamination such as paper dust or dust is hardly attached to the colorimetric window part 11.

Colorimetric Measurement State

As already shown in FIG. 3, when the colorimeter 10 is performing a colorimetric measurement, the colorimeter 10 is proximal to or in contact with the facing member 16. The reason for this is that the colorimeter 10 has to read the test pattern on the recording material P that is being conveyed on the double-sided conveyance path D. That is to say, the colorimeter 10 is projected toward the double-sided conveyance path D, and the recording material P is sandwiched between and conveyed by the colorimeter 10 and the facing member 16. At that time, the colorimetric window part 11 is in friction with the recording material P. Accordingly, even if the surface (face in contact with the recording material P) of the colorimetric window part 11 has been contaminated to some extent, the contamination can be cleaned with the leading edge of the recording material P or portions (white paper portions) left before and after the test pattern on the recording material P to which toner has not been attached.

Double-Sided Printing State (Separation State)

There are two modes in the double-sided printing state. After an image is formed on a first face of the recording material P, the recording material P has to pass through the double-sided conveyance path D for image formation on a second face. At that time, the image formation control unit 56 rotates the cam unit 15, thereby withdrawing the colorimeter 10 to the outside of the double-sided conveyance path D. Accordingly, it is possible to reduce the possibility that the recording material P is jammed at the position where the colorimeter 10 is disposed. Furthermore, since the recording material P is not sandwiched between the colorimeter 10 and the facing member 16, image defects due to the friction hardly occur. The biasing force of the biasing springs 13 is originally designed such that no problem occurs for paper feeding and colorimetric measurement in the colorimetric measurement state, and, thus, the adverse effect is small even if the colorimeter 10 and the facing member 16 are in contact with each other. However, it is difficult to assure the adverse effect to be completely zero as long as friction is generated between the colorimeter 10 and the facing member 16. Thus, in order to further reduce the possibility that the problem due to the friction occurs, the colorimeter 10 and the facing member 16 are basically separated from each other in the double-sided printing state.

Double-Sided Printing State (Contact State)

As described above, when the colorimeter 10 and the facing member 16 are separated from each other, paper dust, toner powder, dust, and the like may be attached to the colorimetric window part 11. Thus, the colorimeter 10 is actively brought into contact with the recording material P under a predetermined condition. The colorimetric window part 11 is in slight sliding friction with the recording material P, and, thus, contamination of the colorimetric window part 11 can be reduced. FIG. 7 shows this state. Since this drawing only shows the state in which the recording material P is sandwiched between the colorimetric window part 11 and the facing member 16 in the double-sided printing state, the recording material P is indicated by the broken line.

Hereinafter, the states of the colorimeter 10 in the respective image forming modes will be described with reference to FIG. 8. This table shows a comparison between a comparative example and an embodiment. In this comparative example, the colorimeter 10 is in a separation state when colorimetric measurement is not being performed. Accordingly, the colorimetric window part 11 of the colorimeter 10 is exposed, and, thus, it seems that contamination is easily attached to the colorimetric window part 11 in the single-sided printing mode and the double-sided printing mode.

On the other hand, in this embodiment, the colorimetric window part 11 of the colorimeter 10 is in contact with the facing member 16 in the single-sided printing mode. Thus, contamination is hardly attached to the colorimetric window part 11. Even in the double-sided printing mode, when a predetermined condition is satisfied, the colorimetric window part 11 is brought into contact with the facing member 16. In this manner, in Embodiment 1, the colorimetric window part 11 is kept in contact with the facing member 16 in the single-sided printing mode, the colorimetric measurement mode, and the double-sided printing mode (when a specific condition is satisfied). Accordingly, contamination is hardly attached to the colorimetric window part 11. Furthermore, in the states other than the above, also in a waiting state in which no image forming is performed, it is possible to suppress attachment of contamination to the colorimetric window part 11 by arranging the colorimetric window part 11 and the facing member 16 in contact with each other.

Colorimeter Contact Conditions in the Double-Sided Printing Mode

It is assumed that the image forming apparatus 100 has a processing capability of 40 PPM. Here, 40 PPM refers to a capability to form images on 40 sheets of A4 landscape recording materials P per minute. It is assumed that the image forming apparatus 100 is operated at full capacity to form images on approximately 200000 sheets per month. Assuming that the number of actual operation days per month is 20, the number of sheets output per day is 10000. If approximately 10% of these sheets are subjected to double-sided printing, 1000 sheets pass through the double-sided conveyance path D. Investigation carried out by the present inventors found that, even if 2000 sheets are fed to the double-sided conveyance path D in a state in which the colorimetric window part 11 is exposed, the amount of contamination such as paper dust attached to the colorimetric window part 11 is sufficiently small. That is to say, it was found that the influence on the colorimetric measurement is small.

Incidentally, most of users who want to perform color calibration management using the colorimeter 10 perform colorimetric calibration when the number of sheets output by the image forming apparatus 100 reaches a predetermined number of sheets. If it is assumed that the predetermined number of sheets is 1000, every time 1000 sheets are fed, an operation that arranges the colorimeter 10 in a contact state is performed simultaneously with the colorimetric measurement. Thus, if paper feeding is performed regularly every 1000 sheets, it is possible to assure that the cleaning function due to friction between the colorimetric window part 11 and the recording material P eliminates the influence of the colorimetric window part 11 of the colorimeter 10 on the measurement. Accordingly, it seems that the colorimetric window part 11 does not have to be in contact with the recording material P in the double-sided printing mode.

There may be other users who do not usually perform color calibration operation, but want to perform color management from time to time. Accordingly, these users perform colorimetric calibration operation at an arbitrary time. In the single-sided printing mode, the colorimetric window part 11 of the colorimeter 10 is usually covered by the facing member 16. Accordingly, the possibility that the colorimetric window part 11 is contaminated is very small. On the other hand, in the double-sided printing mode, the recording material P passes through the double-sided conveyance path D in principle in a state in which the colorimetric window part 11 is not protected by the facing member 16. Accordingly, if this state continues for a long period of time, the possibility that the colorimetric window part 11 is contaminated will increase.

The limit value for the number of sheets that can be fed without contamination of the colorimetric window part 11 is 2000 sheets, as described above. For example, if the threshold is set to half of this limit value with a certain degree of leeway, i.e., to 1000 sheets, 1000 sheets can be fed. Thus, when 1000 sheets of recording materials P are fed to the double-sided conveyance path D, the image formation control unit 56 forcibly positions the colorimeter 10 to be projected into the double-sided conveyance path D and be brought into contact with the recording material P, thereby cleaning the colorimetric window part 11 with the recording material P.

Note that a specific cleaning time may be, for example, when the last recording material P passes by the colorimeter 10 in a double-sided printing job in which 1000 sheets of recording materials P pass through the double-sided conveyance path D. This timing may be effective also regarding a job waiting time of the users. Note that the recording material P that is used to clean the colorimeter 10 is limited to the last recording material because of the following reason. That is, if a high density image formed on the recording material P is brought into contact with the colorimeter 10, traces of friction may appear. Furthermore, a conveyance failure (so-called jam) of the recording material P may occur. It is considered that the occurrence possibility is proportional to the number of sheets of recording materials P brought into contact with the colorimeter 10. Accordingly, it is desirable to reduce the number of sheets of recording materials P brought into contact with the colorimeter 10.

In this manner, even if the users perform color calibration management on an irregular basis, in this embodiment, the colorimetric window part 11 is cleaned with the recording material P according to the number of sheets of recording materials P that pass through the double-sided conveyance path D, so that contamination of the colorimetric window part 11 can be suppressed. Furthermore, since the precision of the colorimetric measurement can be accordingly maintained, the user can always utilize a stable color calibration management state. Note that this threshold for determining the cleaning time is merely an example, and the number of sheets for image formation may be freely set for example, according to conditions such as an individual difference between image forming apparatuses or a level of precision needed by the user.

Flowchart

Figures 8, 9:
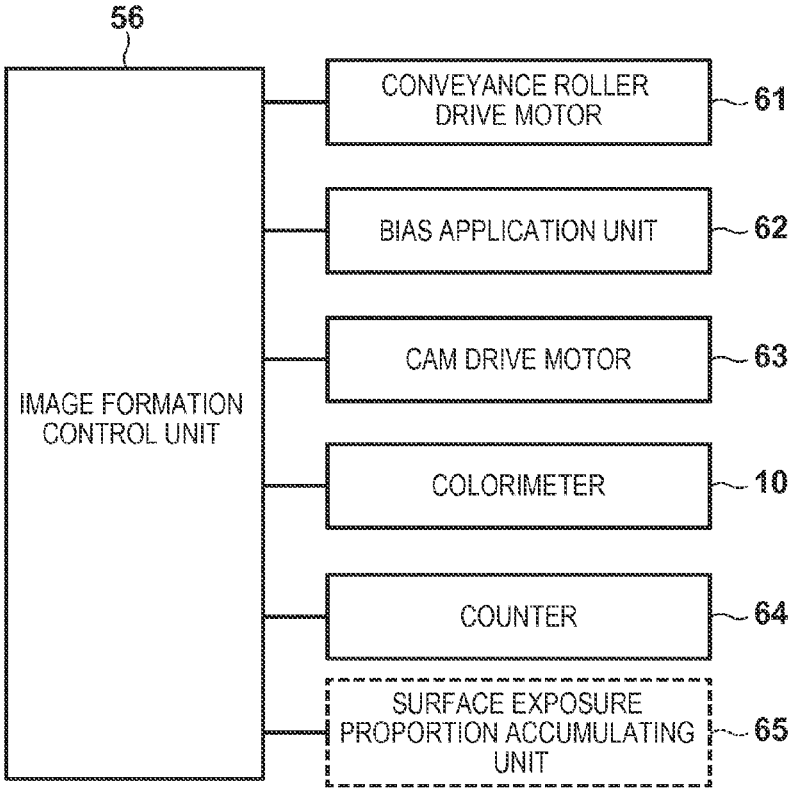
FIG. 8 is a table showing contact/separation states of respective modes in an example and a comparative example.
FIG. 9 is a view showing the outline of a control unit.

FIG. 9 shows an example of the control unit. A conveyance roller drive motor 61 drives the conveyance rollers in response to a drive signal supplied from the image formation control unit 56. The number of conveyance roller drive motors 61 may be plural or may be one. If the number of conveyance roller drive motors 61 is small, a plurality of conveyance rollers may be individually driven via electromagnetic clutches or gears. A bias application unit 62 generates a charge bias, a development bias, and a transfer bias in response to a voltage setting signal supplied from the image formation control unit 56. A cam drive motor 63 functions as a drive unit that drives the colorimeter 10 or the facing member 16 such that the colorimeter 10 and the facing member 16 are closer to each other or separated from each other. The cam drive motor 63 drives the cam unit 15, for example, in response to a drive signal supplied from the image formation control unit 56. That is to say, the image formation control unit 56 is an example of a control unit that controls the drive unit. The colorimeter 10 reads the test pattern T formed on a recording material, and outputs the reading result to the image formation control unit 56. The image formation control unit 56 adjusts tint-related image forming conditions according to the reading result of the test pattern T. A counter 64 counts the number of sheets of recording materials P that pass through the double-sided conveyance path D. A surface exposure proportion accumulating unit 65 is optionally provided, and functions as an accumulating unit that obtains and accumulates surface exposure proportions of recording materials that pass through the double-sided conveyance path D, based on densities of images formed on the recording materials.

Figure 10A:
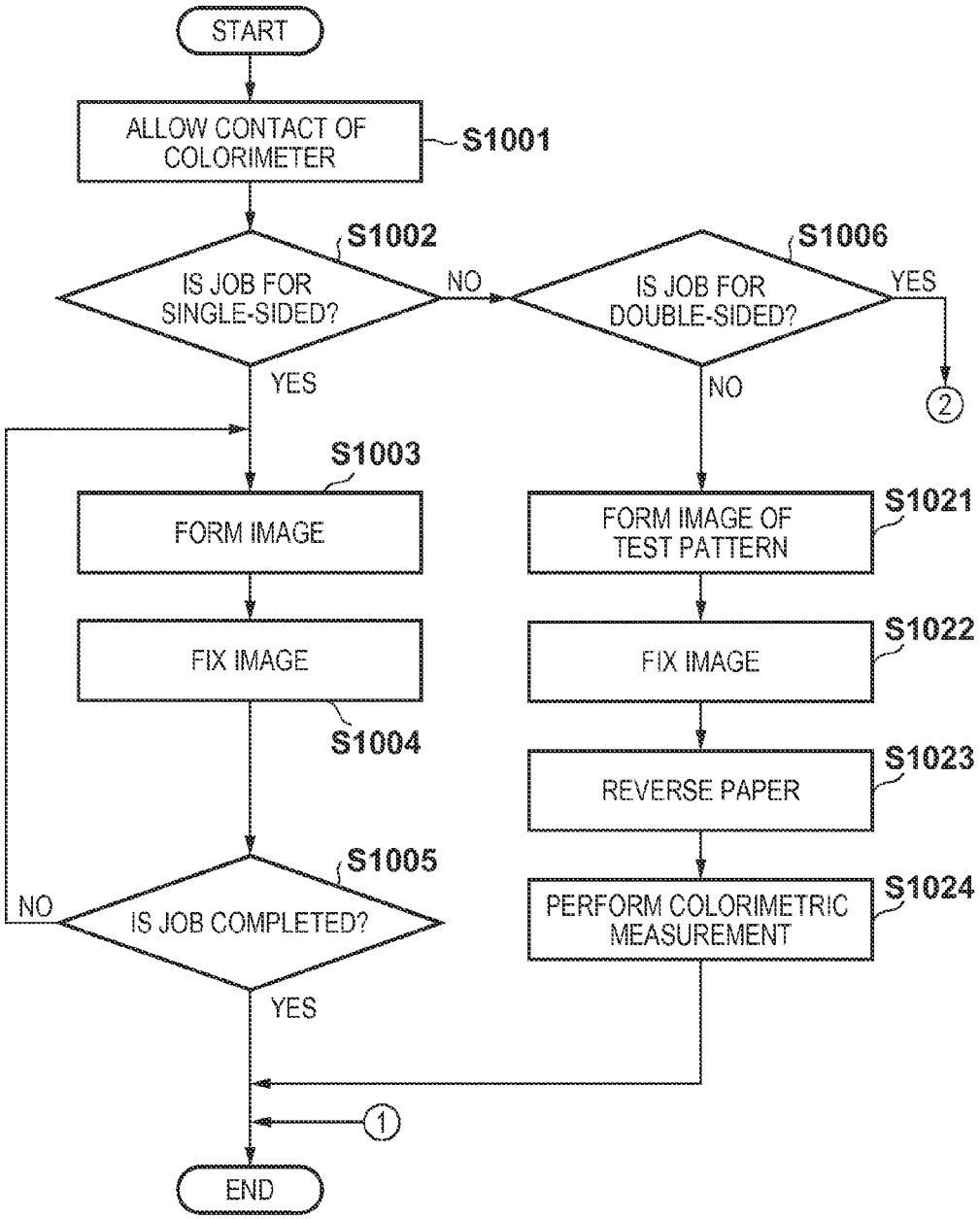
FIGS. 10A and 10B are flowcharts showing an image forming method including a process that cleans the colorimetric window part.
Figure 10B:
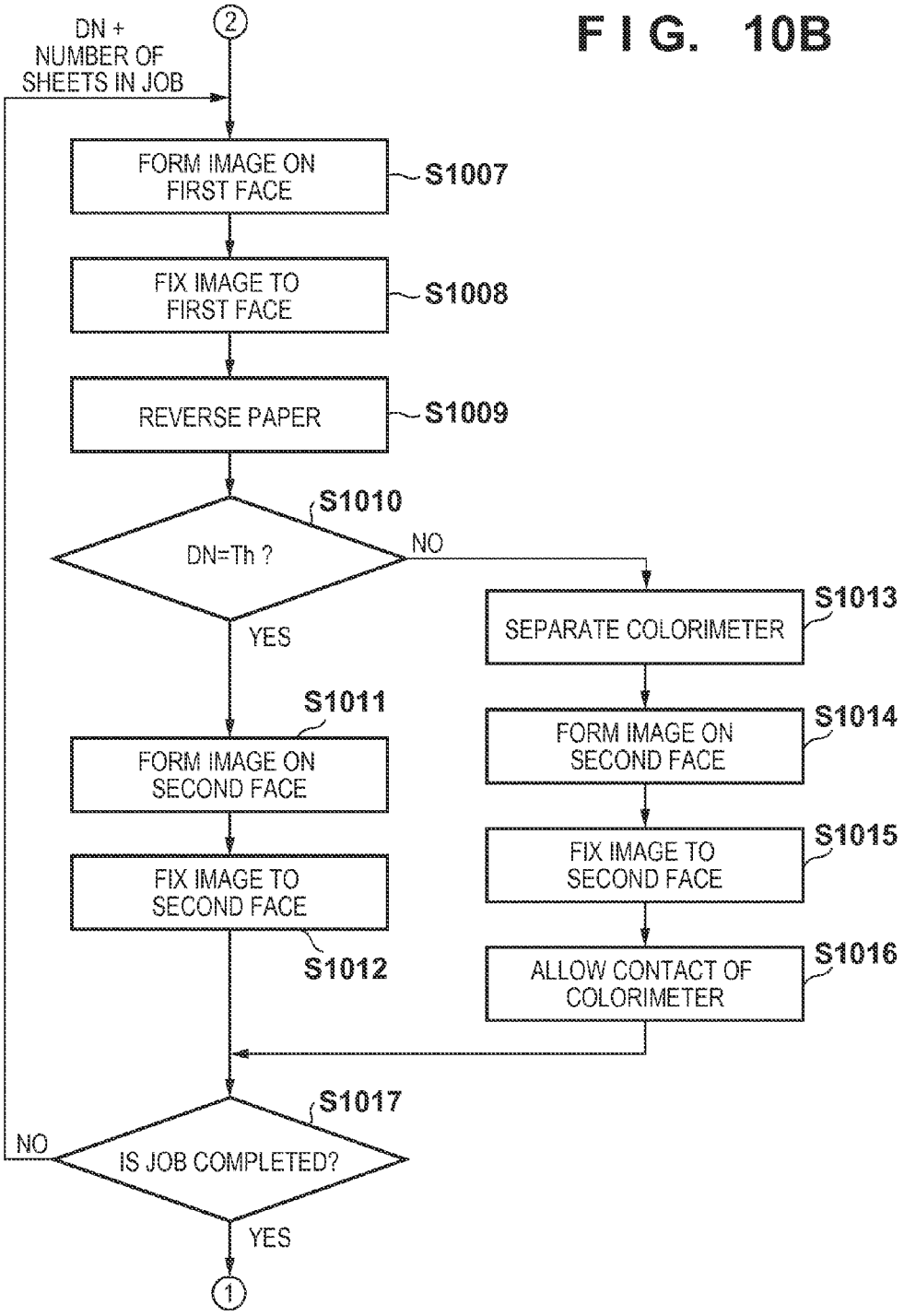

FIGS. 10A and 10B are flowcharts showing a series of processes relating to this embodiment. Note that, in this embodiment, part or the whole of the function of the image formation control unit 56 may be realized by the main body control unit 55.

In S1001, the image formation control unit 56 controls the cam drive motor 63 to rotate the cam unit 15, in order to allow contact of the colorimetric window part 11 of the colorimeter 10 with the facing member 16. If the colorimetric window part 11 is in contact with the facing member 16, the colorimetric window part 11 is protected by the facing member 16. Note that, if the colorimetric window part 11 is already in contact with the facing member 16, this process may be omitted.

In S1002, the image formation control unit 56 determines whether or not the job is a single-sided printing job according to the job data received by the main body control unit 55. If the job is a single-sided printing job, the procedure advances to S1003.

In S1003, the image formation control unit 56 controls the image forming unit to form a toner image on the recording material P. In S1004, the image formation control unit 56 controls the fixing unit 51 to fix the unfixed toner image to the recording material P. In S1005, the image formation control unit 56 determines whether or not formation of all images instructed by the job has been completed based on the job data. If the job has been completed, the series of processes in this flowchart are ended, and the procedure shifts to the waiting mode. If the job has not been completed, the procedure returns to S1003 where a next image is formed on the recording material P. On the other hand, if it is determined in S1002 that single-sided printing is not instructed, the procedure advances to S1006.

In S1006, the image formation control unit 56 determines whether or not double-sided printing is instructed based on the job data. If double-sided printing is instructed, the procedure advances to S1007.

In S1007, the image formation control unit 56 controls the image forming unit to form an image of a first face on a first face of the recording material P. In S1008, the image formation control unit 56 controls the fixing unit 51 to fix the toner image on the first face to the first face of the recording material P. In S1009, the image formation control unit 56 controls the conveyance roller drive motor 61, thereby controlling the discharge rollers 50 to reverse the paper that is about to be discharged. The process that reverses the paper that is about to be discharged refers to a process in which the recording material P on which a toner image has been formed on the first face thereof is guided to the double-sided conveyance path D such that the second face of the recording material P faces the intermediate transfer belt 37.

In S1010, the image formation control unit 56 acquires from the counter 64 data indicating the number of sheets of recording materials P that passed through the double-sided conveyance path D, and determines whether or not a value DN of data indicating the number of sheets matches a threshold Th. The threshold Th is a value corresponding to a predetermined condition, and is a value indicated as 1000 in the description above. The event that the value DN matches the threshold Th means that the time to clean the colorimetric window part 11 has come. Accordingly, in this case, the procedure advances to S1011. In this state, the colorimetric window part 11 is in contact with the facing member 16. Accordingly, when the recording material P is conveyed to the double-sided conveyance path D, the leading edge of the recording material P enters a contact point between the colorimetric window part 11 and the facing member 16, and cleans contamination of the colorimetric window part 11. In S1011, the image formation control unit 56 controls the image forming unit to form an image of a second face on a second face of the recording material P. In S1012, the image formation control unit 56 controls the fixing unit 51 to fix the toner image on the second face to the second face of the recording material P. Note that, when the cleaning is completed, the counter 64 is reset, and DN is set to zero. Subsequently, the procedure advances to S1017. On the other hand, if DN is not Th in S1010, (i.e., if DN is less than Th), the cleaning is not necessary. Accordingly, the procedure advances to S1013.

In S1013, the image formation control unit 56 controls the cam drive motor 63 to rotate the cam unit 15, in order to separate the colorimetric window part 11 of the colorimeter 10 from the facing member 16. Accordingly, the colorimetric window part 11 is separated from the facing member 16, and the recording material P on which the image has been fixed on the first face thereof passes through the double-sided conveyance path D substantially without friction with the colorimetric window part 11. Note that, if the recording material P that is being conveyed is undulating, the recording material P may be brought into contact with the colorimetric window part 11, but this contact will hardly damage the toner image. In S1014, the image formation control unit 56 controls the image forming unit to form an image of a second face on a second face of the recording material P. In S1015, the image formation control unit 56 controls the fixing unit 51 to fix the toner image on the second face to the second face of the recording material P. In S1016, the image formation control unit 56 controls the cam drive motor 63 to rotate the cam unit 15, in order to allow contact of the colorimetric window part 11 of the colorimeter 10 with the facing member 16. Accordingly, the colorimetric window part 11 is again in contact with and is protected by the facing member. Subsequently, in S1017, the image formation control unit 56 determines whether or not formation of all images instructed by the job has been completed based on the job data. If the job has been completed, the series of processes in this flowchart are ended, and the procedure shifts to the waiting mode. If the job has not been completed, the image formation control unit 56 adds the number of sheets of this job to DN, and the procedure returns to S1007 where the procedure shifts to the process that forms a next image. On the other hand, if double-sided printing is not instructed in S1006, (i.e., if colorimetric measurement is instructed), the procedure advances to S1021.

In S1021, the image formation control unit 56 controls the image forming unit to form an image of the test pattern T on the recording material P. In S1022, the image formation control unit 56 controls the fixing unit 51 to fix the test pattern T to the recording material P. In S1023, the image formation control unit 56 controls the discharge rollers 50 to perform the process that reverses the paper that is about to be discharged, thereby guiding the recording material P to the double-sided conveyance path D. In S1024, the image formation control unit 56 causes the colorimeter 10 in the contact state to colorimetrically measure the test pattern T, and adjusts the image forming conditions based on the colorimetric measurement result such that the tint of output images is kept ideal. Subsequently, the procedure shifts to the waiting mode.

Embodiment 2

In this embodiment, the contact mode of the colorimeter 10 described in Embodiment 1 is changed as follows. According to Embodiment 1, the colorimeter 10 is in the contact state as an initial state, and basically shifts to the separation state during image forming on a second face. Furthermore, every time the number of sheets that pass through the double-sided conveyance path D reaches a predetermined number of sheets, the colorimeter 10 is positioned proximal to or in contact with the facing member 16. Accordingly, the recording material P and the colorimetric window part 11 are in slight sliding friction with each other, and cleaning of the colorimetric window part 11 is realized.

In this manner, in Embodiment 1, the number of sheets of recording materials P that pass through the double-sided conveyance path D is taken as the cleaning execution condition in S1010. However, the cleaning execution condition is not limited to the number of sheets of recording materials P as long as the cleaning can be properly executed. For example, the amount of toner used for image forming also may be taken into consideration. That is to say, the proportion of non-image regions (regions in which the surface of the recording material P is not covered by toner and is exposed) varies between a plurality of recording materials P according to formed images. In the non-image regions, the surface of the recording material P is exposed in a larger area, and the amount of paper dust generated from the recording material P will increase. Thus, the image formation control unit 56 uses the surface exposure proportion accumulating unit 65 to calculate pixels on which toner is to be placed based on the image data, and obtains a difference between these pixels and all pixels on the recording material P, thereby obtaining a surface exposure amount, which corresponds to regions with no image formed thereon. Accordingly, it is possible to see how much non-image regions is included in the recording material P on which image forming has been performed. It is possible to determine the time to clean the colorimeter 10, by obtaining and accumulating this surface exposure amount every time image forming is performed, and comparing the accumulated value with a predetermined threshold. Accordingly, the cleaning can be performed at an optimal time according to the regions of formed images, and, thus, the cleaning can be performed based on a more precise presumption of the contamination level of the colorimeter 10.

Embodiment 3

In Embodiment 1, it is taken as the cleaning condition in S1010 that the number of sheets of recording materials P that pass through the double-sided conveyance path D reaches a predetermined number of sheets. In Embodiment 2, the density of an image formed on the recording material P that passes through the double-sided conveyance path D is taken into consideration to determine the cleaning condition in S1010.

Incidentally, the density of an image on the recording material P used to clean the colorimetric window part 11 may be high as in the case of a photographic image or may be low as in the case of an image containing a large amount of character data. During cleaning of the colorimetric window part 11, the colorimetric window part 11 and the recording material P are in friction with each other, and, thus, part of the image may be scratched. Although an image containing a large amount of character data or a low density image will have a high acceptable level for scratch of part of the image, a high density image such as a photographic image will have a low acceptable level.

Thus, the image formation control unit 56 may analyze the density of the formed image after the conditions described in Embodiments 1 and 2 are satisfied, and may perform determination to skip the cleaning if the image is a photographic image or a high density image, and to execute the cleaning if the image is an image containing a large amount of character data or a low density image. Note that, if the cleaning is executed when a no-data state that may occur several time during the job (i.e., a white paper state) is detected, the problem of image scratch can be avoided to the extent possible. The reason for this is that there is not image that may be scratched on the recording material P.

Embodiment 4

Figure 11:
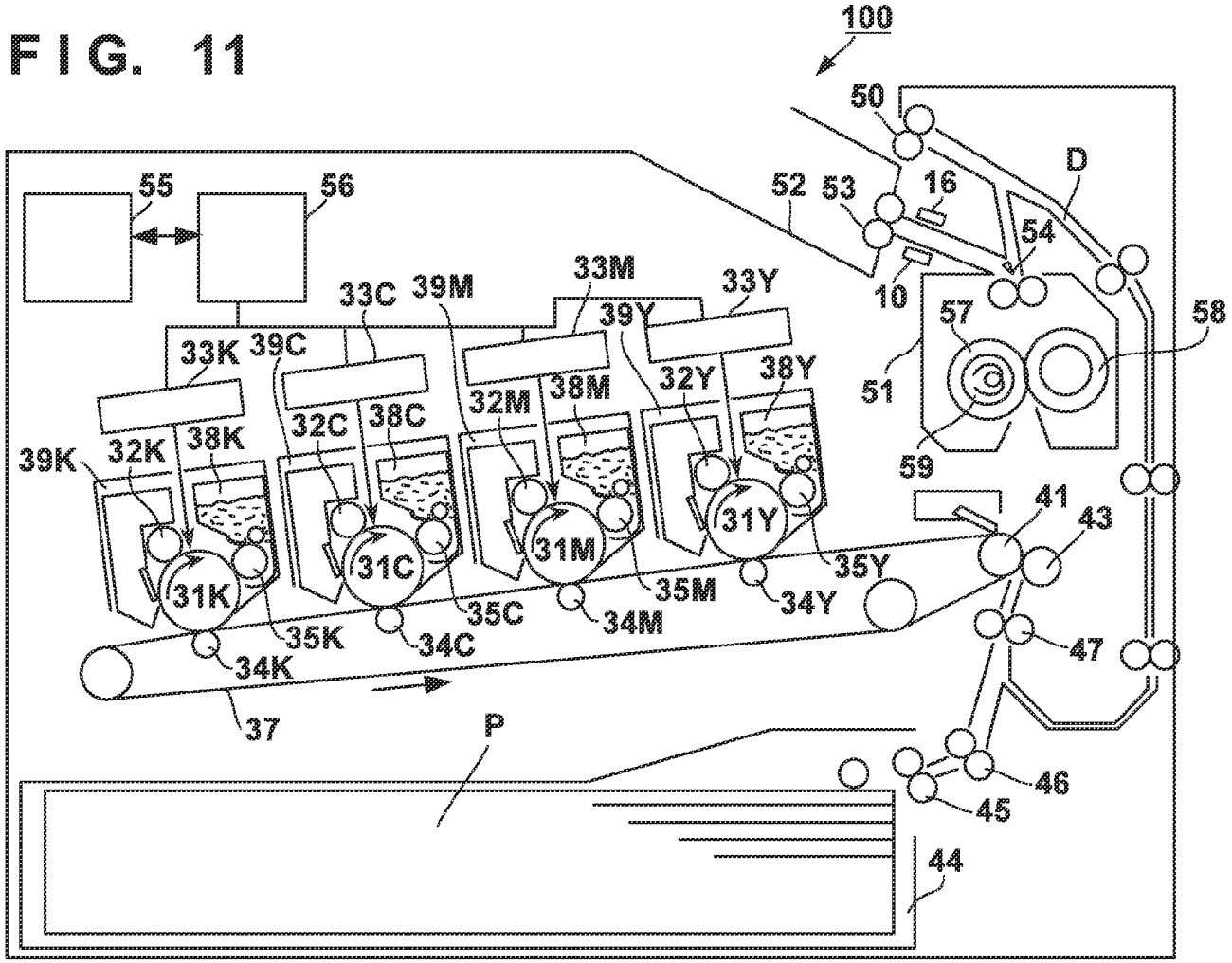
FIG. 11 is a view showing another example of an image forming apparatus.

Although the colorimeter 10 is disposed on the double-sided conveyance path D in Embodiments 1 to 3, the colorimeter 10 may be disposed on the conveyance path downstream of the fixing unit 51 as shown in FIG. 11. According to FIG. 11, two conveyance paths are switched by a flapper 54. In this embodiment, the downstream conveyance path is provided with the colorimeter 10 and the facing member 16. The outlet of this conveyance path is provided with discharge rollers 53. In this manner, the colorimeter 10 may be provided at any point as long as it is on the conveyance path downstream of the fixing unit 51.

Incidentally, the problem caused by performing tint correction in a state in which paper dust, dust, or the like is attached to the colorimetric window part 11 will be further described. Generally, in order to maintain the precision of the colorimetric measurement for each tint correction, it is necessary that the colorimeter 10 reads a white reference plate and adjusts the amount of light emitted from the light emitting unit included in the colorimeter 10 to a standard light amount. In this example, it is assumed that the facing member 16 is used also as the white reference plate. If paper dust, dust, or the like is attached to the colorimetric window part 11 at the time of reading the white reference plate, the amount of light emitted cannot be accurately adjusted to the standard light amount. In particular, even if the colorimetric window part 11 is contaminated at the time of reading the white reference plate, the colorimetric window part 11 is cleaned with the recording material P at the time of reading the test pattern T. That is to say, the state of the colorimetric window part 11 is different between when reading the white reference plate and when reading the test pattern T. In particular, the amount of light received by the light receiving unit inside the colorimeter 10 is larger in a state in which paper dust, dust, or the like is not attached to the colorimetric window part 11 than in a state in which such a substance is attached. The tint correction is an operation in which the image formation control unit 56 calculates the tint for the white color based on the result obtained by colorimetrically measuring the white reference plate after when light amount adjustment is performed before when the recording material P reaches the colorimeter 10 and the result obtained by colorimetrically measuring the test pattern after the recording material P reaches the colorimeter 10, and provides feedback to image forming conditions. Accordingly, if the amount of light received by the light receiving unit is different between when colorimetrically measuring the white reference plate and when colorimetrically measuring the test pattern, the precision of the colorimetric measurement result is lowered, and the tint correction becomes erroneous.

Thus, Embodiment 4 is characterized in that the colorimetric measurement is skipped also in the case where the result obtained by colorimetrically measuring the white reference plate differs from a predetermined colorimetric measurement result. Note that the other processes in Embodiment 4 may be the same as those in Embodiments 1 to 3.

Figure 12:
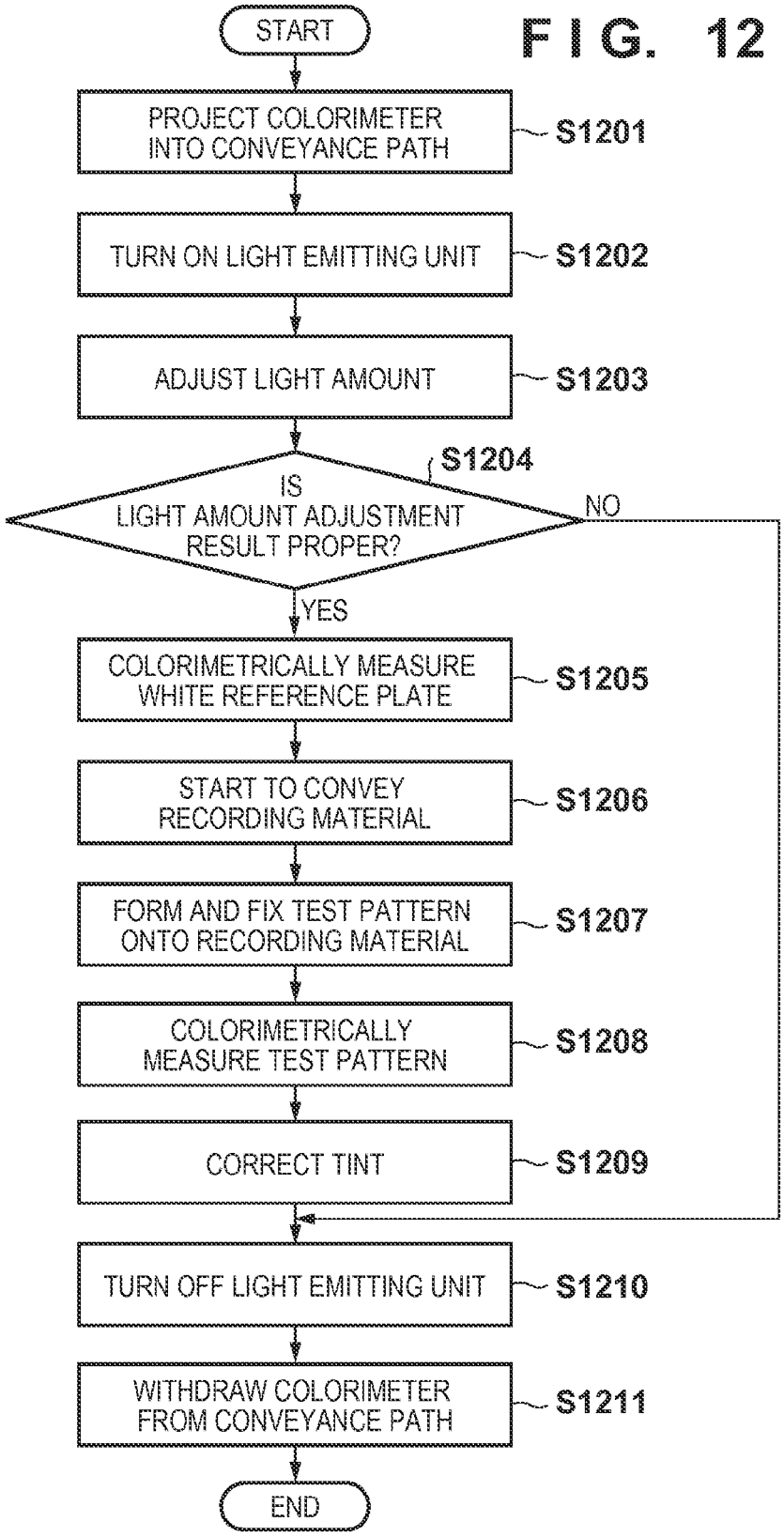
FIG. 12 is a flowchart showing the details of a colorimetric measurement mode.

Hereinafter, the tint correction sequence in Embodiment 4 will be described with reference to FIG. 12. In S1201, the image formation control unit 56 controls the cam drive motor 63 to rotate the cam unit 15, thereby positioning the colorimeter 10 projected into the conveyance path.

In S1202, the image formation control unit 56 controls the colorimeter 10 to turn on the light emitting unit (LED) included in the color sensor 17. The light from the light emitting unit is reflected by the white reference plate provided as the facing member 16, and is incident on the light receiving unit of the color sensor 17. In S1203, the image formation control unit 56 acquires the result obtained by causing the light receiving unit included in the color sensor 17 to receive light reflected by the white reference plate, and adjusts the amount of light emitted from the light emitting unit such that the light receiving result matches a desired light receiving result. The light amount adjustment is performed in order to ensure the reproducibility of the colorimetric measurement result and the S/N ratio. Note that the light amount adjustment is well known in the art, and, thus, a detailed description thereof has been omitted.

In S1204, the image formation control unit 56 determines whether or not the value set for the light emitting unit through the light amount adjustment is within a predetermined range, thereby determining whether or not the light amount adjustment has been properly performed. If the result of the light amount adjustment is not proper due to contamination of the colorimetric window part 11, the procedure advances to S1210. In S1210, the image formation control unit 56 turns off the light emitting unit. In S1211, the image formation control unit 56 controls the cam drive motor 63 to rotate the cam unit 15, thereby withdrawing the colorimeter 10 from the conveyance path, so that the tint correction is ended. On the other hand, if the result of the light amount adjustment is proper, the procedure advances to S1205.

In S1205, the image formation control unit 56 controls the colorimeter 10 to colorimetrically measure the white reference plate provided as the facing member 16. In S1206, the image formation control unit 56 controls the conveyance roller drive motor 61 to start to convey the recording material P. In S1207, the image formation control unit 56 controls the image forming unit to form the test pattern T on the recording material P, and further controls the fixing unit 51 to fix the toner image to the recording material P. Subsequently, the recording material P is guided by the flapper 54 to the conveyance path on which the colorimeter 10 is provided.

In S1208, the image formation control unit 56 controls the colorimeter 10 to colorimetrically measure the test pattern T formed on the recording material P. In S1209, the image formation control unit 56 performs the tint correction based on the result obtained by colorimetrically measuring the test pattern T. Subsequently, the light emitting unit is turned off in S1210, and the colorimeter 10 is withdrawn from the conveyance path in S1211, so that the tint correction is ended.

Embodiment 5

In Embodiment 1 and the like, in order to suppress attachment of contamination to the colorimetric window part 11, the colorimetric window part 11 is in contact with the facing member 16 in the single-sided printing mode and the like. That is to say, in the initial state, the colorimetric window part 11 is in principle in contact with the facing member 16. On the other hand, the colorimetric window part 11 may be in principle separated from the facing member 16 in the initial state, and may be cleaned as necessary. For example, upon determining that the value counted by the counter 64 reaches a predetermined number of sheets (threshold Th (e.g., 1000 sheets)), the image formation control unit 56 determines whether or not the conveying of the last recording material P in the job that is being executed is started. If the conveying of the last recording material P is started, the image formation control unit 56 brings the colorimetric window part 11 into contact with the facing member 16, and cleans the colorimetric window part 11 with the last recording material P. The image formation control unit 56 measures the contact duration of the colorimetric window part 11, and, if the contact duration reaches a threshold duration, controls the cam drive motor 63 to rotate the cam unit 15, thereby withdrawing the colorimeter 10 from the conveyance path. In this manner, cleaning of the colorimetric window part 11 may be performed as necessary.

Embodiment 6

In Embodiment 4, if the result of the light amount adjustment is proper, the tint correction using the test pattern T is performed, and, if the adjustment result is not proper, the tint correction is skipped, so that the tint correction based on erroneous colorimetric measurement results can be avoided.

Incidentally, before the tint correction, the colorimetric window part 11 has to be cleaned at a proper time. If the colorimetric window part 11 can be kept clean, the result of the light amount adjustment in S1204 becomes proper, and the tint correction can be performed. Thus, this embodiment is characterized in that the white reference plate is read in a state in which the colorimeter 10 is withdrawn from the conveyance path, and, if the reading result is out of the acceptable range, the colorimetric window part 11 is cleaned. Note that the cleaning of the colorimetric window part 11 refers to a process that positions the colorimeter 10 projected into the conveyance path, and then causes the recording material P to pass through that conveyance path, thereby removing foreign matters attached to the colorimetric window part 11 with the recording material P.

Figure 13:
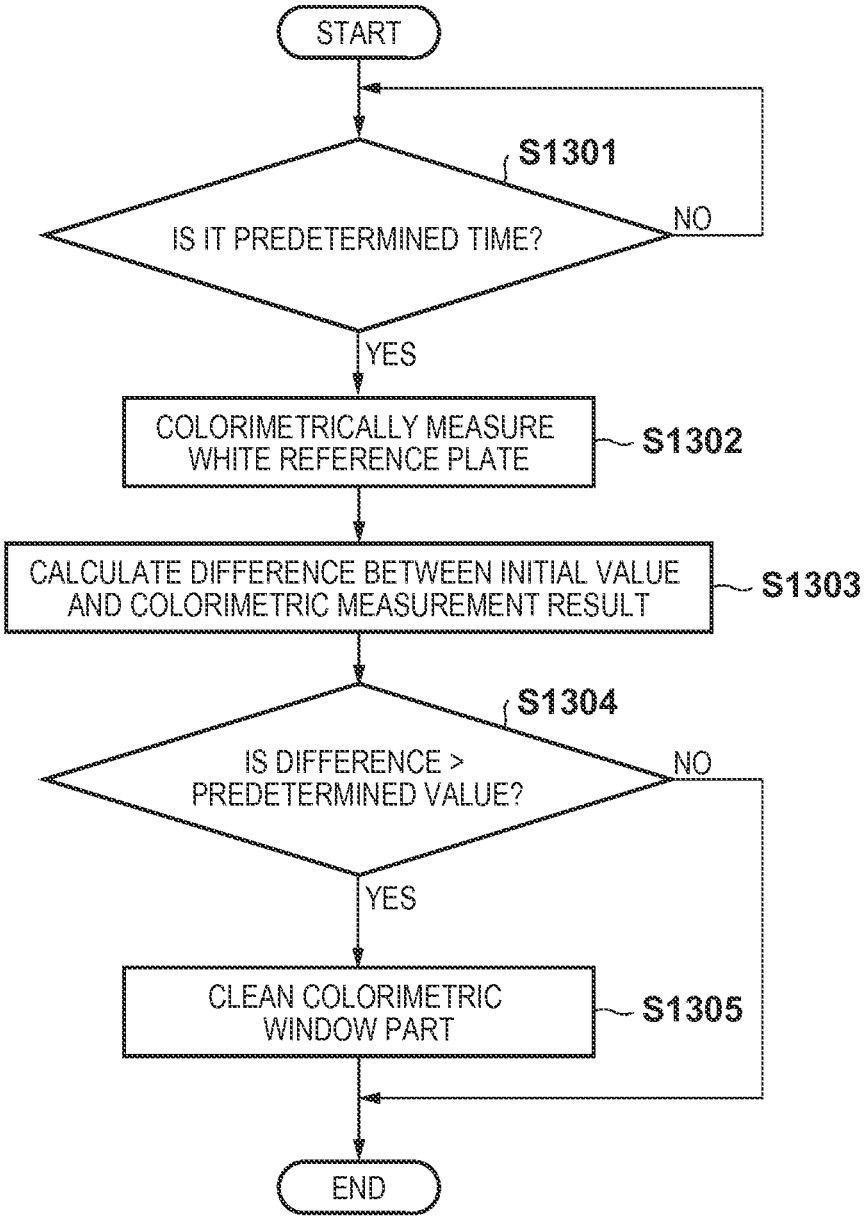
FIG. 13 is a flowchart showing a cleaning process.

Hereinafter, the process that positions the colorimeter 10 projected into the conveyance path, that is, the process that cleans the colorimetric window part 11 will be described with reference to FIG. 13. Note that, during production of the image forming apparatus 100 or at the time of shipment thereof from plants, the white reference plate is colorimetrically measured in a state in which the colorimeter 10 is withdrawn from the conveyance path, and the colorimetric measurement result is stored as a standard value in a storage device included in the image formation control unit 56. Note that the value indicating the amount of light emitted used when acquiring the standard value is also stored in the storage device.

In S1301, the image formation control unit 56 determines whether or not the predetermined time to check a contamination state of the colorimetric window part 11 has come. The predetermined time is, for example, the time at which images are formed on a predetermined number of sheets (e.g., 1000 sheets, etc.) or more after the previous tint correction was performed. Furthermore, the predetermined time may be, for example, the time at which the time that has passed after the previous tint correction was performed reaches a predetermined period of time. Furthermore, the predetermined time may be, for example, the time at which the operation duration of the image forming apparatus 100 after the previous tint correction was performed reaches a predetermined period of time. These timings are properly set according to experiences, experiments, or simulations. If the predetermined time has come, the procedure advances to S1302.

In S1302, the image formation control unit 56 causes the colorimeter 10 to colorimetrically measure the white reference plate provided as the facing member 16 in a state in which the colorimeter 10 is withdrawn from the conveyance path (i.e., the same state as that in which the standard value is measured). Specifically, the colorimeter 10 is caused to colorimetrically measure the white reference plate in a state in which the colorimeter 10 is withdrawn from the conveyance path, and at the amount of light emitted when the standard value is acquired.

In S1303, the image formation control unit 56 calculates a difference between the colorimetric measurement result and the standard value read from the storage device. Note that the difference increases according to the contamination level of the colorimetric window part 11. Specifically, paper dust or the like attached to the colorimetric window part 11 blocks light reflected by the white reference plate, thereby changing the brightness (lightness).

In S1304, the image formation control unit 56 determines whether or not the difference is larger than a predetermined value. If the difference is larger than the predetermined value, it seems that the colorimetric window part 11 is contaminated beyond the acceptable range, and, thus, the procedure advances to S1305. If the difference is not larger than the predetermined value, contamination of the colorimetric window part 11 is within the acceptable range, and, thus, cleaning of the colorimetric window part 11 is skipped.

In S1305, the image formation control unit 56 cleans the colorimetric window part 11 as described above. That is to say, the image formation control unit 56 controls the cam drive motor 63 to rotate the cam unit 15, thereby positioning the colorimeter 10 projected into the conveyance path. Accordingly, the colorimetric window part 11 and the recording material P are brought into contact with each other. When the recording material P is caused to pass through that conveyance path, contamination is cleaned by the friction. Note that the time to position the colorimeter 10 projected into the conveyance path may be the time immediately before the last recording material P reaches the colorimeter 10 in the printing job executed after it is determined that the colorimetric window part 11 of the colorimeter 10 is contaminated.

In this manner, the contamination level of the colorimetric window part 11 is checked as appropriate by the colorimeter 10, and, if the contamination is beyond the acceptable range, the colorimeter 10 is projected into the conveyance path such that the recording material P and the colorimetric window part 11 are in friction with each other, and, thus, the contamination of the colorimetric window part 11 can be removed. Accordingly, it is possible to reduce the situation in which paper dust or the like is attached to the colorimetric window part 11 before the tint correction. Accordingly, if the colorimetric measurement is performed in this state, the precision of the colorimetric measurement can be maintained, and stable tint correction can be realized.

Others

According to Embodiments 1 to 6, when the colorimeter 10 is colorimetrically measuring the test pattern T, the image formation control unit 56 controls the cam drive motor 63 such that the colorimeter 10 and the facing member 16 are closer to each other, and, thus, the recording material on which the test pattern has been formed is brought into contact with the colorimeter 10. Furthermore, even when the colorimeter 10 is not colorimetrically measuring the test pattern T, in the case where a predetermined contact condition is satisfied, the image formation control unit 56 controls the cam drive motor 63 such that the colorimeter 10 and the facing member 16 are closer to each other, and, thus, the recording material P on which the test pattern T has been formed is brought into contact with the colorimeter 10. In this manner, opportunities to clean the colorimetric window part 11 of the colorimeter 10 with the recording material P increases, and, thus, contamination of the colorimetric window part 11 of the colorimeter 10 can be reduced.

As described in Embodiments 1 to 4, even when the colorimeter 10 is not colorimetrically measuring the test pattern, the image formation control unit 56 may control the cam drive motor 63 such that the colorimeter 10 and the facing member 16 are closer to each other before a predetermined separation condition is satisfied. According to Embodiment 1, the predetermined separation condition refers to performing double-sided printing or allowing the recording material P to pass through the double-sided conveyance path D.

As described with reference to FIG. 1, the colorimeter 10 and the facing member 16 may be provided on the double-sided conveyance path D through which, for image forming on both of a first face and a second face of a recording material, the recording material on which an image has been formed on the first face thereof is conveyed in order to form an image on the second face of the recording material. Alternatively, as shown in FIG. 11, the colorimeter 10 and the facing member 16 may be provided on a conveyance path other than the double-sided conveyance path D as long as it is a conveyance path positioned downstream of the fixing unit 51 in the conveyance direction of the recording material P.

As described in Embodiment 1 and the like, also in the case where single-sided printing is instructed, the image formation control unit 56 may control the cam drive motor 63 such that the colorimeter 10 and the facing member 16 are closer to each other. Accordingly, the duration during which the colorimeter 10 is protected by the facing member 16 can be made longer, and, at the same time, the duration during which the colorimetric window part 11 of the colorimeter 10 is exposed can be made shorter.

As described in Embodiment 1 and the like, also in the case where double-sided printing is instructed, the image formation control unit 56 controls the cam drive motor 63 such that the colorimeter 10 and the facing member 16 are in principle closer to each other. Accordingly, the duration during which the colorimeter 10 is protected by the facing member 16 can be made longer, and, at the same time, the duration during which the colorimetric window part 11 of the colorimeter 10 is exposed can be made shorter. Furthermore, when a recording material on which an image has been formed on the first face thereof passes through the double-sided conveyance path D, the image formation control unit 56 may control the cam drive motor 63 such that the colorimeter 10 and the facing member 16 are temporarily separated from each other. Accordingly, it is possible to reduce the possibility that the image formed on the first face is scratched or that the recording material P is jammed near the colorimeter 10.

As described in Embodiment 1 and the like, if a predetermined contact condition (S1010, etc.) is satisfied, the image formation control unit 56 may control the cam drive motor 63 to keep the colorimeter 10 and the facing member 16 closer to each other such that contact of the recording material P with the colorimeter 10 is allowed, even when a recording material on which an image has been formed on the first face thereof passes through the double-sided conveyance path D. Accordingly, even in the double-sided printing mode, cleaning of the colorimetric window part 11 with the recording material P can be performed when the cleaning seems to be necessary.

The predetermined contact condition may be that the value counted by the counter 64 reaches a predetermined number of sheets (e.g., 1000 sheets), or may be that the conveying of the last recording material P is started in a job that is being executed when the counted value reaches a predetermined number of sheets or a job that is executed immediately after the counted value reaches a predetermined number of sheets. In the latter case, the image formation control unit 56 controls the cam drive motor 63 such that the last recording material in a job that is being executed when the counted value reaches a predetermined number of sheets or a job that is executed immediately after the counted value reaches a predetermined number of sheets is brought into contact with the colorimeter 10.

As described in Embodiment 2, the surface exposure proportion accumulating unit 65 may be further provided that obtains and accumulates surface exposure proportions of recording materials that pass through the double-sided conveyance path D, based on densities of images formed on the recording materials. In this case, the predetermined contact condition may be that an accumulated value of the surface exposure proportions reaches a predetermined value. Paper dust and the like are generated more often in portions in which a toner image is not formed or portions in which the density of the toner image is low on the surface of the recording material P. Accordingly, it is considered that, if the density of a toner image is taken into consideration to set the contact condition, the cleaning can be performed at a more proper time.

When a predetermined contact condition is satisfied, the image formation control unit 56 may control the cam drive motor 63 such that the colorimeter 10 and the facing member 16 are closer to each other over a predetermined period of time. As described in Embodiments 4, 5, and the like, the colorimeter 10 and the facing member 16 may be in principle separated from each other, and the contact process may be performed when a predetermined contact condition is satisfied. In this case, if the contact process is performed over a period of time determined to be sufficient to complete the cleaning according to experiences, experiments, or simulations, the contact duration can be made shorter. It is considered that, if the contact duration is made shorter, the possibility that the toner image is scratched can be reduced.

Note that, if the counter 64 counts the number of sheets on which images are formed by the image forming apparatus 100 or the number of sheets of recording materials that pass through a conveyance path provided with the colorimeter 10, the predetermined contact condition may be that the value counted by the counter 64 reaches a predetermined number of sheets. In this manner, even in the case where the colorimeter 10 and the facing member 16 are in principle separated from each other, the cleaning can be properly performed according to the number of sheets of recording materials. Furthermore, the image formation control unit 56 may control the cam drive motor 63 such that the last recording material in a job that is being executed when the counted value reaches a predetermined number of sheets or a job that is executed immediately after the counted value reaches a predetermined number of sheets is brought into contact with the colorimeter 10.

As described in Embodiment 5, when the time to perform calibration has come in which the colorimeter 10 is caused to read the white reference plate provided as the facing member 16, the image formation control unit 56 turns on the light emitting unit of the colorimeter 10 and adjusts the light amount. Furthermore, the image formation control unit 56 performs the calibration if the result of the light amount adjustment satisfies a predetermined adjustment result, and does not perform the calibration if the result of the light amount adjustment does not satisfy a predetermined adjustment result. Accordingly, in the case where the colorimetric window part 11 is contaminated and the result of the light amount adjustment is out of the acceptable range, the calibration and the tint correction are not performed, and, thus, erroneous tint correction can be avoided. Note that the time to perform the calibration may be the time at which the number of sheets on which images are formed by the image forming apparatus 100 reaches a predetermined number of sheets, the time at which the number of sheets of recording materials P that pass through a conveyance path provided with the colorimeter 10 reaches a predetermined number of sheets, the time at which the operation duration of the image forming apparatus 100 reaches a predetermined period of time, or the like.

As described in Embodiment 6, the predetermined contact condition may be that the result obtained by the colorimeter 10 colorimetrically measuring the white reference plate provided as the facing member 16 is out of an acceptable range. The reason for this seems to be that, if the result obtained by the colorimeter 10 colorimetrically measuring the white reference plate is out of an acceptable range, the cleaning of the colorimetric window part 11 is necessary.

In Embodiments 1 to 6 described above, the colorimeter 10 is driven by the cam unit 15, but the present invention is not limited to this. For example, a drive mechanism incorporating a solenoid and a link mechanism in combination may be used instead of a motor and a cam.

Furthermore, in this embodiment, an electrophotographic multi-color image forming apparatus using an intermediate transfer belt was described as an example of the image forming apparatus. However, the present invention can be applied also to apparatuses using a so-called transfer conveyance belt. Moreover, the present invention can be applied also to image forming apparatuses using other image forming methods such as inkjet image forming apparatuses or thermal transfer image forming apparatuses.

Furthermore, in Embodiments 1 to 6, the colorimeter 10 was moved, but the facing member 16 may be moved. It is sufficient that the colorimeter 10 and the facing member 16 are shifted between the contact state and the separation state through relative movement thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-005707, filed Jan. 16, 2013 which is hereby incorporated by reference herein in its entirety.

What is claimed is:

1. An image forming apparatus, comprising:

a fixing unit that fixes a toner image to a recording material;

a colorimetric unit that is provided on a conveyance path downstream of the fixing unit in a recording material conveyance direction, and colorimetrically measures a test pattern formed on the recording material;

a facing member that is disposed facing the colorimetric unit with the conveyance path interposed therebetween;

a drive unit that drives the colorimetric unit or the facing member such that the colorimetric unit and the facing member are closer to each other or separated from each other; and a control unit that controls the drive unit, wherein the colorimetric unit and the facing member are provided on a double-sided conveyance path through which, for image forming on both of a first face and a second face of a recording material, the recording material on which an image has been formed on the first face thereof is conveyed in order to form an image on the second face of the recording material, and in a case where single-sided printing is instructed, the control unit controls the drive unit such that the colorimetric unit and the facing member are closer to each other.

2. The image forming apparatus according to claim 1, wherein the control unit controls the drive unit such that the colorimetric unit and the facing member are closer to each other to contact the colorimetric unit with the recording material on which the test pattern has been formed, so that the colorimetric unit is caused to colorimetrically measure the test pattern.

3. The image forming apparatus according to claim 1, wherein in a case where double-sided printing is instructed, the control unit controls the drive unit such that the colorimetric unit and the facing member are closer to each other, and controls the drive unit such that the colorimetric unit and the facing member are temporarily separated from each other when the recording material on which an image has been formed on the first face thereof passes through the double-sided conveyance path.

4. The image forming apparatus according to claim 3, wherein, in a case where a contact condition for contact of the colorimetric unit with the recording material is satisfied, the control unit controls the drive unit to keep the colorimetric unit and the facing member closer to each other such that contact of the colorimetric unit with the recording material is allowed, even when the recording material on which an image has been formed on the first face thereof passes through the double-sided conveyance path.

5. The image forming apparatus according to claim 4, further comprising a counting unit that counts the number of sheets of recording materials that pass through the double-sided conveyance path, wherein the contact condition is that the value counted by the counting unit reaches a predetermined number of sheets.

6. The image forming apparatus according to claim 5, wherein the control unit controls the drive unit such that a last recording material in a job that is being executed when the counted value reaches the predetermined number of sheets or a job that is executed immediately after the counted value reaches the predetermined number of sheets is brought into contact with the colorimetric unit.

7. The image forming apparatus according to claim 4, further comprising an accumulating unit that accumulates surface exposure amounts of recording materials that pass through the double-sided conveyance path, based on image data of an image formed on the recording materials, wherein the contact condition is that the accumulated value of the surface exposure amounts reaches a predetermined value.

8. The image forming apparatus according to claim 1, wherein, in a case where a contact condition for contact of the colorimetric unit with the recording material is satisfied, the control unit controls the drive unit such that the colorimetric unit and the facing member are closer to each other over a predetermined period of time.

9. The image forming apparatus according to claim 8, further comprising a counting unit that counts the number of sheets on which images are formed by the image forming apparatus or the number of sheets of recording materials that pass through a conveyance path provided with the colorimetric unit, wherein the contact condition is that the value counted by the counting unit reaches a predetermined number of sheets.

10. The image forming apparatus according to claim 9, wherein the control unit controls the drive unit such that a last recording material in a job that is being executed when the counted value reaches the predetermined number of sheets or a job that is executed immediately after the counted value reaches the predetermined number of sheets is brought into contact with the colorimetric unit.

11. The image forming apparatus according to claim 1, wherein, when the time to perform calibration has come in which the colorimetric unit is caused to read a white reference plate provided at the facing member, the control unit turns on a light emitting unit of the colorimetric unit to adjust a light amount, and performs the calibration in a case where a result of the light amount adjustment satisfies a predetermined adjustment result, and does not perform the calibration in a case where a result of the light amount adjustment does not satisfy a predetermined adjustment result.

12. The image forming apparatus according to claim 11, wherein the time to perform the calibration is at least one of the time at which the number of sheets on which images are formed by the image forming apparatus reaches a predetermined number of sheets, the time at which the number of sheets of recording materials that pass through the conveyance path provided with the colorimetric unit reaches a predetermined number of sheets, and the time at which an operation duration of the image forming apparatus reaches a predetermined period of time.

13. The image forming apparatus according to claim 4, wherein the contact condition is that a result obtained by the colorimetric unit colorimetrically measuring a white reference plate provided at the facing member is out of an acceptable range.

14. The image forming apparatus according to claim 1, wherein, in a case where a contact condition for contact of the colorimetric unit with the recording material is satisfied, the control unit controls the drive unit such that the colorimetric unit and the facing member are closer to each other, so that contact of the colorimetric unit with the recording material is allowed, regardless of whether or not the test pattern has been formed on the recording material.

15. An image forming apparatus, comprising:

a fixing unit that fixes a toner image to a recording material;

a colorimetric unit that is provided on a conveyance path downstream of the fixing unit in a recording material conveyance direction, and colorimetrically measures a test pattern formed on the recording material;

a facing member that is disposed facing the colorimetric unit with the conveyance path interposed therebetween;

a drive unit that drives the colorimetric unit or the facing member such that the colorimetric unit and the facing member are closer to each other or separated from each other; and a control unit that controls the drive unit, wherein the colorimetric unit and the facing member are provided on a double-sided conveyance path through which, for image forming on both of a first face and a second face of a recording material, the recording material on which an image has been formed on the first face thereof is conveyed in order to form an image on the second face of the recording material, and in a case where double-sided printing is instructed, the control unit controls the drive unit such that the colorimetric unit and the facing member are closer to each other, and controls the drive unit such that the colorimetric unit and the facing member are temporarily separated from each other when the recording material on which an image has been formed on the first face thereof passes through the double-sided conveyance path.

16. An image forming apparatus, comprising:

a fixing unit that fixes a toner image to a recording material;

a colorimetric unit that is provided on a conveyance path downstream of the fixing unit in a recording material conveyance direction, and colorimetrically measures a test pattern formed on the recording material;

a facing member that is disposed facing the colorimetric unit with the conveyance path interposed therebetween;

a drive unit that drives the colorimetric unit or the facing member such that the colorimetric unit and the facing member are closer to each other or separated from each other; and a control unit that controls the drive unit, wherein, in a case where a contact condition for contact of the colorimetric unit with the recording material is satisfied, the control unit controls the drive unit such that the colorimetric unit and the facing member are closer to each other, so that contact of the colorimetric unit with the recording material is allowed, regardless of whether or not the test pattern has been formed on the recording material, and wherein the contact condition is that a result obtained by the colorimetric unit colorimetrically measuring a white reference plate provided at the facing member is out of an acceptable range.

17. The image forming apparatus according to claim 1, wherein a state where single-sided printing is instructed is a state where an image is formed on the first face.

18. An image forming apparatus, comprising:

a fixing unit that fixes a toner image to a recording material;

a colorimetric unit that is provided on a conveyance path downstream of the fixing unit in a recording material conveyance direction, and colorimetrically measures a test pattern formed on the recording material;

a facing member that is disposed facing the colorimetric unit with the conveyance path interposed therebetween;

a drive unit that drives the colorimetric unit or the facing member such that the colorimetric unit and the facing member are closer to each other or separated from each other; and a control unit that controls the drive unit, wherein the control unit is configured to control the drive unit such that the colorimetric unit and the facing member are closer to each other in a state where no recording material is present between the colorimetric unit and the facing member, the state being a measuring idle state where the colorimetric unit does no colorimetric measuring.

19. The image forming apparatus according to claim 18, wherein the colorimetric unit and the facing member are provided on a double-sided conveyance path through which, for image forming on both of a first face and a second face of a recording material, the recording material on which an image has been formed on the first face thereof is conveyed in order to form an image on the second face of the recording material.

* * * * *